US008706459B2

(12) United States Patent
Gupta et al.

(10) Patent No.: US 8,706,459 B2
(45) **Date of Patent: *Apr. 22, 2014**

(54) TRAFFIC SENSOR MANAGEMENT

(75) Inventors: Raj Gupta, New Delhi (IN); Biplav Srivastava, Noida (IN)

(73) Assignee: International Business Machines Corporation, Armonk, NY (US)

( * ) Notice: Subject to any disclaimer, the term of this patent is extended or adjusted under 35 U.S.C. 154(b) by 15 days.

This patent is subject to a terminal disclaimer.

(21) Appl. No.: 13/586,067

(22) Filed: Aug. 15, 2012

(65) Prior Publication Data

US 2013/0090905 A1 Apr. 11, 2013

Related U.S. Application Data

(63) Continuation of application No. 13/253,114, filed on Oct. 5, 2011.

(51) Int. Cl.
*G06G 7/48* (2006.01)

(52) U.S. Cl.
USPC ..... 703/8; 703/6

(58) Field of Classification Search
None
See application file for complete search history.

(56) References Cited

U.S. PATENT DOCUMENTS 3,920,967 A * 11/1975 Martin et al. ..... 701/118
5,400,244 A * 3/1995 Watanabe et al. ..... 701/28
5,798,949 A * 8/1998 Kaub ..... 703/6
5,822,712 A * 10/1998 Olsson ..... 701/117
6,577,946 B2 6/2003 Myr
6,772,082 B2 * 8/2004 van der Geest et al. ..... 702/116
7,155,376 B2 * 12/2006 Yang et al. ..... 703/8
7,197,320 B2 3/2007 Joseph
7,289,904 B2 * 10/2007 Uyeki ..... 701/533
7,415,385 B2 * 8/2008 Azarbayejani et al. ..... 702/182
7,460,691 B2 12/2008 Ng et al.
7,539,593 B2 * 5/2009 Machacek ..... 702/127
7,948,400 B2 5/2011 Horvitz et al.
7,983,839 B2 7/2011 Sutardja
8,046,204 B2 * 10/2011 Trotta et al. ..... 703/6
8,046,205 B2 * 10/2011 Trotta et al. ..... 703/6
2003/0005747 A1 * 1/2003 van der Geest et al. ..... 73/1.16
2005/0228578 A1 10/2005 Burzio
2006/0064234 A1 * 3/2006 Kumagai et al. ..... 701/117

(Continued)

FOREIGN PATENT DOCUMENTS

CN 101505486 A1 8/2009

OTHER PUBLICATIONS

T. A. Nguyen, M. B. Do, S. Kambhampati, and B. Srivastava, "Planning with Partial Preference Models", pp. 1772-1777, 2009.*

(Continued)

*Primary Examiner* — Omar Fernandez Rivas
*Assistant Examiner* — Kibrom Gebresilassie
(74) *Attorney, Agent, or Firm* — Ryan, Mason & Lewis, LLP

(57) ABSTRACT

A method for selecting a subset of at least one traffic sensor includes modeling multiple sensor types to generate at least one sensor model, creating a sample space of at least one sensor combination of multiple sensors, modeling traffic movement of a region, running a traffic simulation based on the at least one sensor model, the sample space of at least one sensor combination and traffic movement of the region, wherein the traffic simulation generates multiple candidate sets of sensors, and selecting a subset of the multiple sensors based on the multiple candidate sets of sensors.

16 Claims, 6 Drawing Sheets

(56) References Cited

U.S. PATENT DOCUMENTS

| | | | | |
|---|---|---|---|---|
| 2006/0082490 | A1* | 4/2006 | Chen et al. | 342/52 |
| 2006/0190217 | A1* | 8/2006 | Lee et al. | 702/181 |
| 2007/0100537 | A1* | 5/2007 | Parikh et al. | 701/117 |
| 2007/0257819 | A1 | 11/2007 | Manor | |
| 2008/0071465 | A1* | 3/2008 | Chapman et al. | 701/117 |
| 2008/0108022 | A1* | 5/2008 | Freund | 434/69 |
| 2008/0126031 | A1* | 5/2008 | Azarbayejani et al. | 703/2 |
| 2009/0043486 | A1* | 2/2009 | Yang et al. | 701/117 |
| 2009/0278672 | A1* | 11/2009 | Weilkes et al. | 340/435 |
| 2009/0303208 | A1* | 12/2009 | Case et al. | 345/204 |
| 2010/0045482 | A1* | 2/2010 | Strauss | 340/903 |
| 2010/0070253 | A1* | 3/2010 | Hirata et al. | 703/8 |
| 2010/0268519 | A1* | 10/2010 | Henning et al. | 703/6 |
| 2010/0292971 | A1* | 11/2010 | Sachse | 703/6 |
| 2011/0050461 | A1 | 3/2011 | Pixley et al. | |
| 2011/0146396 | A1* | 6/2011 | Kim et al. | 73/172 |
| 2011/0313740 | A1* | 12/2011 | Ikeda et al. | 703/2 |
| 2012/0069190 | A1* | 3/2012 | Nam et al. | 348/159 |
| 2013/0090905 | A1* | 4/2013 | Gupta et al. | 703/6 |
| 2013/0173218 | A1* | 7/2013 | Maeda et al. | 702/182 |
| 2013/0204515 | A1* | 8/2013 | Emura | 701/119 |

OTHER PUBLICATIONS

Y. Zhang, E. K. Antonsson, & A. Martinoli, "Evolutionary engineering design synthesis of on-board traffic monitoring sensors" pp. 113-125, Res Eng Design 2008.*

Y. Zhang, E. K. Antonsson, & A. Martinoli, "Evolutionary engineering design synthesis of on-board traffic monitoring sensors" 2008.*

W. Elmenreich, & R. Leidenfrost, "Fusion of Hetrogeneous Sensors Data", 2008, pp. 1-10.*

V. Isler, R. Bajcsy, "The Sensor Selection Problem for Bounded Uncertainty Sensing Models" 2005, pp. 1-10.*

N. Xiong, P. Svensson, "Multi-sensor management for information fusion: issues and approaches", 2001, p. 163-183.*

Bischof et al., Autonomous Audio-Supported Learning of Visual Classifiers for Traffic Monotoring. IEEE Intell. Sys., 25(3) p. 15-23, May/Jun. 2010.

Bramberger et al., A Smart Camera for Traffic Surveillance, WISES03 pp. 12, Vienna, Austria, Jun. 2003.

Zhao, Mobile Phone Location Determination and Its Impact on Intelligent Transportation Systems, IEEE Trans. ITS, vol. 1, No. 1, Mar. 2000, pp. 55-64.

Quddus et al., Current Mapmatching Algorithms for Transport Applications: State-of-the Art and Future Research Directions, Transportation Research, Part C, vol. 15, No. 5, pp. 312-328, Oct. 2007.

Prashanth et al., Nericell: Rich Monitoring of Road and Traffic Conditions Using Mobile Smartphones, Proc. ACM Sensys, p. 323-336, Nov. 2008.

Leduc, Road Traffic Data: Collection Methods and Applications, JRC Technical Notes, 2008, pp. 1-53.

Fei et al., Sensor Coverage and Location for Real-Time Traffic Prediction in Large-Scale Networks, Transportation Research Record: Journal of the Transportation Research Board, No. 2039, Transportation Research Board of the National Academies, Washington, D.C., 2007, pp. 1-15.

Chiti et al, Urban Microclimate and Traffic Monitoring with Mobile Wireless Sensor Networks, InTech, Dec. 2010, pp. 1-14.

Charypar et al., Generating Complete All-Day Activity Plans with Genetic Algorithms, the Physical and Social Dimensions of Travels, 10th International Conference on Travel Behaviour Research, Aug. 2003, pp. 1-24.

Matsim, Multiagent Transport Simulation Toolkit, http://sourceforge.net/projects/matsim, 2010, downloaded Dec. 8, 2011, pp. 1-2.

Raney et al., An Improved Framework for Large-Scale Multiagent Simulations of Travel Behavior, in P. Rietveld, B. Jourquin and K. Westin (eds.), Towards Better Performing European Transportation Systems, 4th Swiss Transport Research Conference, Mar. 2004, pp. 1-38.

Srivastava et al., A New Look at the Traffic Management Problem and Where to Start, in IBM Research Report, Ri 10014, http://domino.watson.ibm.com/library/CyberDig.nsf/home, Nov. 2010, pp. 1-5.

Transims, TRansportation Analysis and SIMulation System, Version:TRANSIMS—3.0, vol. Two—Networks and Vehicles, http://transims.tsasa.lanl.gov/, Los Alamos National Laboratory, Los Alamos, NM, Sep. 2003, pp. 1-137.

Wang et al., Transportation Mode Inference from Anonymized and Aggregated Mobile Phone Call Detail Records, ITS, Madeira Island, Portugal, 2010, pp. 1-6.

Zhu et al., Trajectory Enabled Service Support Platform for Mobile Users' Behavior Pattern Mining, in Proc. MobiQuitous, 2009, pp. 1-10.

Blank et al., A Case Study Towards Evaluation of Redundant Multi-Sensor Data Fusion, CVT 2010—pp. 475-485, Mar. 16-18, 2010, Kaiserslautem, Germany.

Patrick et al., Advances in Multi-Sensor Data Fusion for Ubiquitous Positioning: Novel Approaches for Robust Localization and Mapping, VDE Kongress 2010- E-Mobility, pp. 1-5.

Moshe et al., Real-Time Multi-Sensor Multi-Source Network Data Fusion Using Dynamic Traffic Assignment Models, IEEE ITS, Oct. 2009, pp. 533-538.

Reed, The Pareto, Zipf and Other Power Laws, Economics Letters, pp. 15-19, vol. 74, No. 1, 2001.

Nguyen et al., Planning with Partial Preference Models, IJCAL, 2009, pp. 1772-1777.

Bansal et al. On Using Crowd for Measuring Traffic at Aggregate Level for Emerging Countries. IIWeb workshop, WWW 2011, Hyderabad, India, Mar. 28, 2011.

Carlyle et al. Quantitative comparison of approximate solution sets for bi-criteria optimization problems. Decision Sciences, 34(1), 2003.

Wikipedia, Intelligent Transportation System, http://en.wikipedia.org/wiki/Intelligent_transportation_system, Sep. 15, 2011.

Nguyen et at., Planning with Partial Preference Models, pp. 1772-1777, 2009.

Zhang et al., Evolutionary Engineering Design Synthesis of On-Board Traffic Monitoring Sensors, pp. 113-125, Res Eng Design 2008.

Gupta et al., Sensor Subset Selection for Traffic Management, 2011 14th International IEEE Conference on Intelligent Transportation Systems, Washington DC, USA. Oct. 5-7, 2011, pp. 1628-1633.

Hawas, A Fuzzy-Based System for Incident Detection in Urban Street Networks, Transportation Research C 15 (2007) 69-95.

* cited by examiner

*FIG. 3*

302

*Algorithm:* Recommended Sensor Combination Subset Selection
*Inputs:* A sensor combination subset problem with a solution space S; maximum number of sensor combination required k;
*Output:* A sensor combination set P ($|P| \leq k$);
*Intermediates:* Non Dominated Solution Q ;

```
Begin
01. Q ← Find out the non dominated sensor combination from S.
          ( Q ≤ S )
02. P ← φ
03. while (|P| ≤ k) do
04.         Search for q such that ICP(P ∪ q) < ICP(P) where q ∈ Q
05.         If q is not found then break
06.         P ← P ∪ q
07. Return P
End
```

TRAFFIC SENSOR MANAGEMENT

CROSS-REFERENCE TO RELATED APPLICATIONS

This application is a continuation of U.S. patent application Ser. No. 13/253,114, filed Oct. 5, 2011, incorporated by reference herein.

FIELD OF THE INVENTION

Embodiments of the invention generally relate to information technology (IT), and, more particularly, to traffic management.

BACKGROUND OF THE INVENTION

Transportation is an area requiring attention for many of the world's cities. In situations where intelligent transportation systems (ITS) are used in an effort to manage traffic, city authorities often need to decide what sensors to use to get traffic data for traffic in the region. Multiple approaches exist, varying in accuracy, coverage and cost to install and maintain. Accordingly, a city or other entity can make an initial decision, but with existing approaches, that decision will need to be continually re-visited over time as traffic patterns and technology changes.

Also, existing approaches include merely selecting one sensor method (for example, global positioning system (GPS)) and ignoring other sensing data. Additionally, challenges arise in existing approaches when traffic is mixed and its movement is chaotic. Accordingly, a need exists for a technique incorporating sensors with high coverage, high-accuracy, low-cost, and maintainability.

SUMMARY OF THE INVENTION

In one aspect of the present invention, techniques for traffic sensor management are provided. An exemplary computer-implemented method for selecting a subset of at least one traffic sensor can include steps of modeling multiple sensor types to generate at least one sensor model, creating a sample space of at least one sensor combination of multiple sensors, modeling traffic movement of a region, running a traffic simulation based on the at least one sensor model, the sample space of at least one sensor combination and traffic movement of the region, wherein the traffic simulation generates multiple candidate sets of sensors, and selecting a subset of the multiple sensors based on the multiple candidate sets of sensors.

Another aspect of the invention or elements thereof can be implemented in the form of an article of manufacture tangibly embodying computer readable instructions which, when implemented, cause a computer to carry out a plurality of method steps, as described herein. Furthermore, another aspect of the invention or elements thereof can be implemented in the form of an apparatus including a memory and at least one processor that is coupled to the memory and operative to perform noted method steps. Yet further, another aspect of the invention or elements thereof can be implemented in the form of means for carrying out the method steps described herein, or elements thereof; the means can include (i) hardware module(s), (ii) software module(s), or (iii) a combination of hardware and software modules; any of (i)-(iii) implement the specific techniques set forth herein, and the software modules are stored in a tangible computer-readable storage medium (or multiple such media).

These and other objects, features and advantages of the present invention will become apparent from the following detailed description of illustrative embodiments thereof, which is to be read in connection with the accompanying drawings.

BRIEF DESCRIPTION OF THE DRAWINGS

FIG. 3 is a diagram illustrating an algorithm to determine sensor subset selection, according to an aspect of the invention;

DETAILED DESCRIPTION OF EMBODIMENTS

Figure 1:
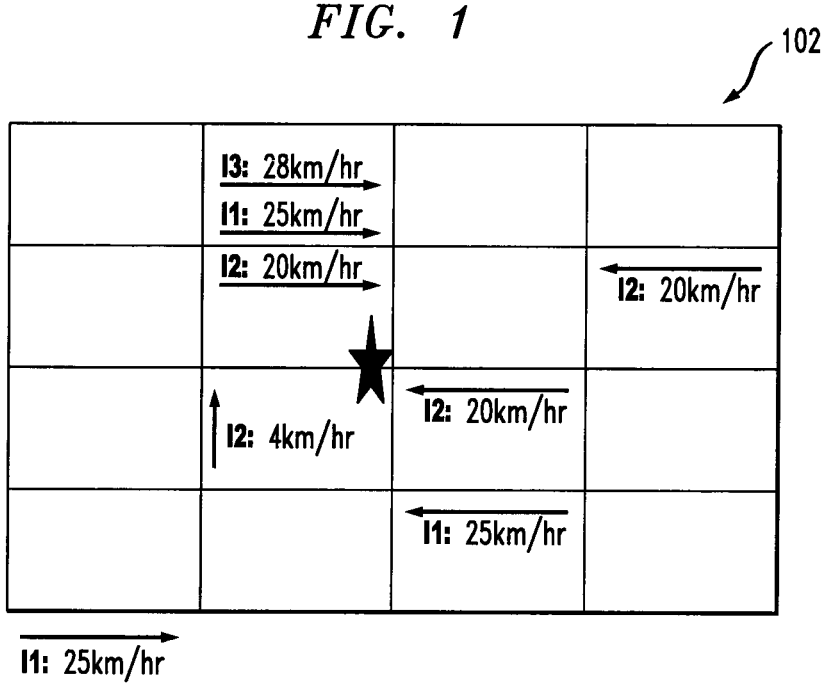
FIG. 1 is an image illustrating a region with multiple traffic sensing techniques, according to an aspect of the invention.

As described herein, an aspect of the present invention includes subset selection of traffic sensors for a given traffic pattern. As detailed herein, an IT driven approach, such as in an embodiment of the invention, can incorporate asset management (for example, indicate what vehicles certain organizations own), as well as sensing what vehicles are moving on the roads. Such techniques also increase supply side (roads, vehicles) and demand side (commuting needs) efficiency to overcome demand-supply mismatches, and make roads safer.

In contrast to existing approaches, aspects of the present invention include providing guidance on what sensors to consider, as well as how to select sensors based on factors such as sensor characteristics, simulation of various sensors, selection method, etc. For instance, sensor readings can be considered from different types of sensors (for example, manual, GPS, video, call data record, mobile) at various locations. Additionally, an aspect of the invention includes preference-driven selection of sensors, as cities or entities may have different preferences based on where they are in an intelligent transportation system (ITS).

Accordingly, as described herein, an aspect of the invention includes determining a subset of sensors from available types that provide a suitable cost-benefit outcome for a given traffic pattern. An embodiment of the invention also includes facilitating selection of future sensors given the information and sensors that are already present.

In one or more embodiments of the invention, sensor types can be modeled based on cost, accuracy and coverage. A sample space of sensor combination choices can be created, and a traffic simulator can be used to measure the sensing error distribution entailed in each sensor combination and to ensure physical characteristics of the city are taken into account. An aspect of the invention also includes choosing Pareto sensor combinations (non-dominated), which can be referred to herein as an optimal candidate set (OCS).

At least one embodiment of the invention additionally include filtering steps such as, for example, removing combinations above a give cost threshold and removing combinations above an error threshold.

According to an embodiment of the invention, for a given set of 'k' optimal combinations to be returned (wherein 'k' is a number of choices sought), a preference function is selected and OCS selection is carried out using Integrated Convex Preference (ICP) approximation. An aspect of the invention then returns 'k' optimal sensor combinations. If a traffic pattern does not change, selecting sensor choice over time can be done on an OCS without re-generating the OCS.

The techniques detailed herein consider both established means of sensing traffic (for example, GPS and video cameras), acquired data from low-cost phones (that is, Call Data Record (CDR)) that have high coverage but give traffic data at coarse granularity, and ground truth. An aspect of the invention includes modeling each sensor's data extraction error, coverage and cost for sensing. Additionally, using a standard traffic simulator, the tradeoffs in using different sensor choices under different sensing configurations and traffic patterns are evaluated.

As described herein, data from CDRs of low-cost phones can complement sensors due to their high-coverage and low-cost despite inherent errors, and a prescriptive method can provide optimal sensor subset selection for a traffic condition. As noted, such a method can include modeling sensor types based on cost, accuracy and coverage, creating a sample space of sensor combination choices, and using a traffic simulator to measure the sensing error distribution entailed in each sensor combination and to ensure physical characteristics of the city are taken into account. Such techniques can also include choosing Pareto-optimal combinations of sensor choices (that is, non-dominated), referred to herein as an optimal candidate set (OCS), and storing and retuning OCS as the output set.

Additionally, in at least one embodiment of the invention, OCS can be filtered to remove combinations above a give cost threshold, to remove combinations above an error threshold, etc.

FIG. 1 is an image 102 illustrating a region with multiple traffic sensing techniques, according to an aspect of the invention. By way of illustration, FIG. 1 depicts an illustrative 5×5 grid region where vehicles are moving. In image 102, all roads are bi-directional. In order to measure traffic, speed and volume (vehicle count) are the fundamental categories of metrics. Sensing technologies allow measuring of one or both of these metrics, but for simplicity, this discussion is restricted to speed measurement.

Traffic can be sensed by multiple methods in this region. In the instant example, ground truth conveyed by humans as they are riding the vehicles 1 (I1) is considered, via video sensors that are placed on the road side (I2), and by using data from mobile phone usage such as CDR, as people carry their phones while they move in the region (I3).

As shown in FIG. 1, the sensors are available only on few places. This can be due, for example, to reasons such as cost and sensor installation over time. Further, some road segments may end up having multiple sensing (thus redundant information with different error rates) while others may have no sensors to track vehicle movement. Table I lists the sensors and their characteristics in the FIG. 1 example. Even the format of data can be different indicating that even collecting the data in a common format together is non-trivial.

TABLE I

| Label | Sensor Type | Data Format | Cost | Accuracy | Coverage |
|---|---|---|---|---|---|
| 11 | Manual, GPS | Document | High | High | Low |
| 12 | Video | Image | Medium | Medium | Low |
| 13 | Call Data Record (mobile) | Binary | Low | Medium | High |

Accordingly, using the available information, an aspect of the invention includes an interest in what overall view of traffic can be provided. Note that in the absence of any systematic sensing effort, there may be already background information from surveys about how fast vehicles move in the particular city. As such, an issue becomes how accurate traffic information may be obtained beyond the background information with sensing technologies.

As detailed herein, an aspect of the invention includes improving sensing accuracy with an increase in the number of sensors, as well as improving sensing accuracy with an increase in the types of sensors used. Moreover, another aspect of the invention determines, if more sensors are placed in the region within a given budget, the type and quantity for the additional sensors. This is referred to herein as the sensor subset selection problem.

Figure 2:
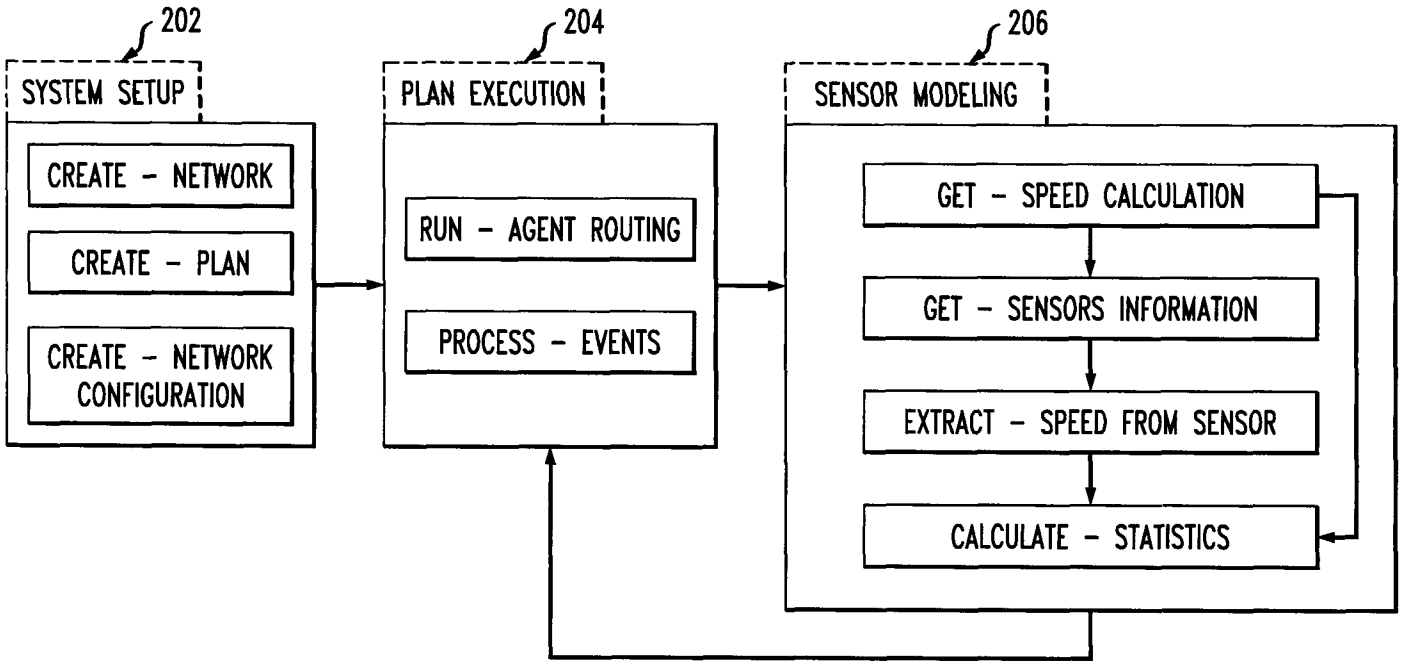
FIG. 2 is a diagram illustrating Matsim architecture, according to an aspect of the invention.

As described herein, Matsim is a multi-agent, open source tool used to design and run traffic oriented simulations for large networks. FIG. 2 is a diagram illustrating Matsim architecture, according to an aspect of the invention. By way of illustration, FIG. 2 depicts a system setup module 202, a plan execution module 204 and a sensor modeling module 206. The system setup module 202 includes creating a network, creating a plan, and creating a network configuration. The plan execution module 204 uses input from the system setup module 202 (as well as from sensor modeling module 206) to run an agent routing and process events. Plan execution module then provides input to sensor modeling module 206, which determines a speed calculation, sensors information, extracts speed from the sensors and calculates statistics.

Matsim utilizes a modular approach wherein default modules can be replaced for aspects such as traffic data, coordinate system and road network, visualization and comparison of strategies. New modules can also be added.

The input to Matsim includes a network file which specifies the nodes and links representing the roads of a city region, a plan file representing the vehicles modeled as agents in the region with their source and destinations, and travel requirements, and a network configuration file representing how the vehicles' speed may change over time. The tool supports event-driven simulation. When the plan is in execution, the simulator processes the events, evaluates the path options for agents and ranks them using scoring functions. At least one embodiment of the invention considers the agent as a vehicle and chooses plans which get executed. This may trigger more events whereby the process repeats.

In further description of FIG. 2, system setup module 202 supports creation and processing of input files needed to simulate traffic. With this, the behavior of roads (links) and vehicles (agents) can be specified and dynamically modified. In creating a network, agents (vehicles) move on a predefined road network in Matsim. The network is composed of nodes and links. The node holds the location information while the link is defined between two nodes and contains length, number of vehicles, default speed and number of lanes information. At any interval of time, if the number of vehicles on a link exceeds its carrying capacity, a congestion event will occur. And for each congestion event, all agents participating in it incur a penalty.

In creating a plan, the behavior of an agent is fully determined through its plan. An agent holds an activity plan and it extracts the information required by the simulation out of this plan. An embodiment of the invention includes using Djikstra's algorithm (called ReRoute Djikstra) to dynamically find paths (plan) in the network. In a plan, an agent has information about (i) departure location, (ii) departure time, (iii) arrival location and (iv) arrival time (required only if the agent is en-route). In creating a network configuration, an aspect of the invention includes initializing the links (roads) with default speed. To change the speed during simulation, one can specify the starting time, the link identifier and the scale factor by which speed changes over time.

The plan execution module 204 includes, after setup, initiating the execution of plans which will lead to agent committing to routes and events getting processed, leading to further re-routing and events getting generated. Agent routing determines paths for agents, scores their choices, and for each agent, commits to the best determined plans. The selected plans trigger new events which the simulator tracks. In processing events, there are various event types in Matsim related to when an activity ends, an agent departs from origin, waits at a link, leaves a link, enters a link and arrives at destination.

As illustrated in FIG. 2, an aspect of the invention also includes extensions to Matsim for running sensing experiments; for example, sensor modeling module 206. To allow evaluation and simulation of sensing trade-offs, profiles of different sensing technologies are defined and Matsim is extended to support sensing behavior based on these profiles.

In building profiles for sensors, as noted earlier, there is a rich set of traffic sensors available for selection. The sensors can be broadly classified into those which are stationary and can be installed along roads, and those which are movable and thus can be available on vehicles moving in the city. By way of example, consider the following sensors.

Manual methods include humans observing traffic and reporting the measurements. Historically, a transportation community has obtained volume data by recruiting field staff to count traffic passing through a reference point. Manual sensing can be considered the ground truth and an example of stationary sensing. Manual sensing can be very precise but very costly to arrange, and the coverage may be low.

Video camera based methods includes a video camera continuously monitoring the lanes of a road. This raw feed is analyzed using software to identify number of vehicles in the video as well as their speeds. Video cameras are typically mounted on poles or structures above or adjacent to the roadway, and are thus stationary sensors. Video Camera based methods are expensive to install and operate, and need extensive computation. However, they are accurate in non-cloudy weather and when traffic is fairly homogeneous and moves in lanes.

GPS based methods include the use of a device mounted on vehicles to track their location and relaying this data to a server. The server can process the speed of vehicles reporting their data as well calculate aggregate traffic volume information. GPS devices use global navigation satellites for accurate reporting which works well in open areas. The devices are costly and not all vehicles may adopt it due to privacy or energy consumption considerations. This is a form of movable sensing.

Mobile phone based methods include people driving their vehicles and carrying their mobile phones. To support these phones, telecommunication companies (telcos) track phones at the granularity of cells to provide basic mobile coverage. The cell information can be analyzed to find how people are moving in space and time at a coarse level of granularity. There are many sub-technology choices, viz., measuring signal strength, requiring people to call and CDRs to be generated, which impose varying level of additional expenditure for the telcos but can deliver increased accuracy. Mobile phone based methods are inexpensive and can provide wider coverage, but the speed calculated using them can contain errors. This is a form of movable sensing.

Table II displays profiles of the sensors based on their error, cost per reading and spatial coverage.

TABLE II

| Data Type | Format | Error | Cost per reading | Coverage |
|---|---|---|---|---|
| Manual | Document | 0% | 5 | Road Link |
| Video | Image, Video | 10% | 4 | Road Link |
| Mobile Phone | Binary | 20% (hop 0)<br>30% (hop 1) | 1 | Neighbourhood |
| GPS | Follow format of data traffic | 5% | 3 | Vehicle |

With respect to error, every sensor has its own characteristics and Table II provides a given typical error with the methods. With respect to cost per reading, a sensor reading has many components, such as, for example, the cost to set up the sensor, the cost to read the raw value, the cost to collect the data and the cost to convert it to traffic data (for example, speed). Table II shows relative cost. Note that manual data has high sensor placement cost while video and GPS have upfront installation costs. GPS has a high data collection cost while video and mobile have high analysis cost.

With respect to coverage, every sensor generates a reading for a particular road link. Moreover, in Mobile/CDR, traffic data can be obtained for link neighborhoods.

As also illustrated in FIG. 2, an aspect of the invention includes extending Matsim to support sensing (see module 206). Note that information about how a vehicle is moving on the road is already available in Matsim. An embodiment of the invention makes a distinction between observable information, where sensors are present to report speed at a particular error rate characteristic of that sensor, and hidden information, where there is no sensor and the error rate depends on the background speed knowledge and actual information. In the extreme case of no sensors being used, all traffic information is hidden.

According, sensor modeling module 206 includes the following capabilities. In determining a speed calculation, the event extracted information from agent route management includes time, event type, vehicle identifier, and link identifier. Whenever there is an event (e1) of 'leaves a link' event type for vehicle (v1), link (l1) and time (t1), an aspect of the invention extracts the event (e2) of 'enters a link' event type for vehicle v1 and link l1. If multiple events of 'enters a link' type of person v1 and link l1 are obtained, then an aspect of the invention uses the one with the latest timestamp and calls that timestamp t2. The distance information for the link l1 is extracted from the system setup module 202.

Denote distance for link l1 as d1. Using the time and distance information, an aspect of the invention can calculate the speed (s1) of a vehicle v1 on link l1 as:

$$s1 = \frac{d1}{(t2 - t1)}$$

Now an aspect of the invention can create speed information using speed s1, link l1 and vehicle v1.

In determining or calculating sensors information, behavior and information extraction has already been carried for the vehicle. For speed information, an aspect of the invention includes determining if this reading is observable or hidden. Sensors are present on select links and vehicles. Accordingly, both the cases will be checked using speed information. If sensor is found, the sensor profile is used to calculate the sensed reading. The Gaussian function can be used to calculate the error for the sensed reading. In case of coverage, the reading from the nearest sensor has higher accuracy.

In extracting speed from sensor information, for speed information, the speed is determined through sensor sensed reading. If redundant sensor readings are available, the sensor reading which has least sensor type error is first selected. If no reading is available, the default network speed is used.

In calculating statistics, various statistics are calculated using the actual and sensor extracted information for every event. Statistics can include, for example, for a given interval of time (for example, an hour), maximum speed, minimum speed, maximum volume, and minimum volume.

The techniques detailed herein can additionally include, for a given number k, an optimal approximation of OCS is returned. This can include selecting a preference function, as well as performing OCS selection using ICP approximation. Also, an aspect of the invention includes selecting k subsets of traffic sensors when OCS and a belief distribution are given. Further, another aspect of the invention includes optimally extending the sensors in a region given a current sensor layout via modeling current traffic conditions in a simulator and determining sensor combinations for new cost/error thresholds.

Accordingly, as detailed herein, an embodiment of the invention includes determining a preferred sensor combination subset. In at least one embodiment of the invention, the methodology is dived in two parts. The first part determines a frontier sensor combination subset from the sensor combination space. The second part uses the objective criteria on the frontier sensor combination subset to determine the preferred sensor combination subset. A frontier acts as basis to select a decision and objective criteria factors act as a model to provide the preferences.

The basis to choose a right decision is solved by Pareto Dominance. At least one embodiment of the invention includes using the Integrated Convex Preferences (ICP) to provide the preferences.

Pareto Dominance determines a non-trivial set which satisfies the specific criteria. Let N be the set of positive integers. For $n \epsilon N$, $R^n$ is the n-dimensional Euclidean space. Let $R = U_{n \epsilon N} R^n$ be the set of finite dimensional vectors of real numbers. Let $x \epsilon R$, and the dimension of x is denoted by dim(x). As such, x is Pareto Dominance of $y \Leftrightarrow \dim(x) = \dim(x) = \dim(y)$ and $x_i <= y_i$ for all coordinates i. Pareto Dominance finds the non dominated solutions by eliminating all of the y in a given set.

Integrated Convex Preference (ICP) has been used to measure the quality of a solution set in a wide range of multi optimization problems. To calculate the ICP function, the user needs to specify a probability distribution $h(\alpha)$ of parameter a such that $\int_\alpha h(\alpha)d\alpha = 1$ and a function $f(p_i, \alpha): S \rightarrow R$ (where S is the solution space) combines different objective functions into a single real valued quality measure for solution p. The ICP value of the solution set P is a subset of S is defined as:

$$ICP(P) = \sum_{i=1}^{k} \int_{w_{i-1}}^{w_i} h(w) \times f(p_i, w) dw$$

where $w_0 = 0$, $w_k = 1$ and $_{pi} = \text{argmin}_{p \epsilon P} f(p,w)\ \forall\ w \epsilon [w_{i-1}, w_i]$.

In other words, w [0,1] is divided into non overlapping regions such that in each region $(w_{i-1}, w_i)$ there is a single solution $p_i \epsilon P$ that has better $f(p_i, \alpha)$ value than all other solutions in P. The ICP(P) can be interpreted as the expected utility value of the best solution of P using the probability distribution $h(\alpha)$ on the trade off value $\alpha$.

Additionally, an aspect of the invention includes using a preference model for sensor combination. Pareto Dominance and ICP are used to create an algorithm, and these approaches are also modeled for sensor combination. As noted above, Pareto Dominance is used to find out the Non-Dominated Pareto solutions. In a general case of Pareto Dominance, this has been described using n dimension. But in this detailed example, a city administrator mentions two dimensional as cost and root-mean-square error (RMSE). Accordingly, Pareto Dominance can be defined as "Let A and B be a sensor combination, and A can be said as dominated by B if costA<costB and RMSE-A<RMSE-B."

A sensor combination set can be reduced by using the Pareto Dominance. Factors can also be incorporated to reduce the space using ICP.

In, ICP the user need to specify the objective function which is defined as:

$$f(p_i, \alpha) = (\alpha \times \text{Cost}_{p_i} + (1-\alpha) \times \text{RMSE}_{p_i})$$

where $$\text{Cost}_{p_i} = (\beta \times \text{CostInst}_{p_i} + (1-\beta) \times \text{CostMa int}_{p_i})$$

where constant are in the range of $\alpha \epsilon [0, 1]$ and $\beta \epsilon [0, 1]$.

An aspect of the invention includes using the ICP in sequential approach to determine the k solution set.

As also noted above, an aspect of the invention includes an algorithm using the Pareto Dominance and ICP. The algorithm determines the preferred sensor combination subset. The algorithm in FIG. 3 shows the pseudo code for this approach. Accordingly, FIG. 3 is a diagram illustrating an algorithm 302 to determine sensor subset selection, according to an aspect of the invention.

As noted, the Pareto Dominance is used to determine the non-dominated sensor combination subset. Also, ICP determines the preferred sensor combination subset. Let S be the set of all sensor combination set given as input. An aspect of the invention includes creating a sensor combination subset Q which contains non-dominated solutions.

As seen in algorithm 302 in FIG. 2, a non-dominated solution has been found using Pareto Dominance criteria from S in Step 1. A preferred sensor combination subset P is created in Step 2. Initially, P is set to an empty set. Collection of preferred sensor combination subsets is carried out in a sequential manner. In every step of the sequential manner, a sensor combination is seeded which lowers the overall value of ICP. After finding the seed sensor combination, it is added to P set. This sequential manner is carried out until the number of sensor combination in P reaches k or it is not able to get a seed sensor combination (Steps 3-6). The algorithm terminates and returns the preferred sensor combination subset P (Step 7).

A preferred sensor combination subset is determined from the sensor combination set detailed above. It implies a sensor combination set is required for computing a preferred sensor combination subset for a city scenario. A sensor combination set can have information regarding the cost and RMSE. A Matsim traffic simulator with a sensor notion module determines the cost and RMSE for a sensor combination. A Matsim simulator with a sensor notion module is referred to herein as SMatsim. SMatsim is an event-driven simulator and requires specifying the inputs. System integration preference approaches with SMatsim can be used to create a system for a city administrator or similar entity. The framework, in at least one embodiment of the invention, is divided into three parts as input, sensor modeling, and sensor combination selection as shown in FIG. 4.

Figure 4:
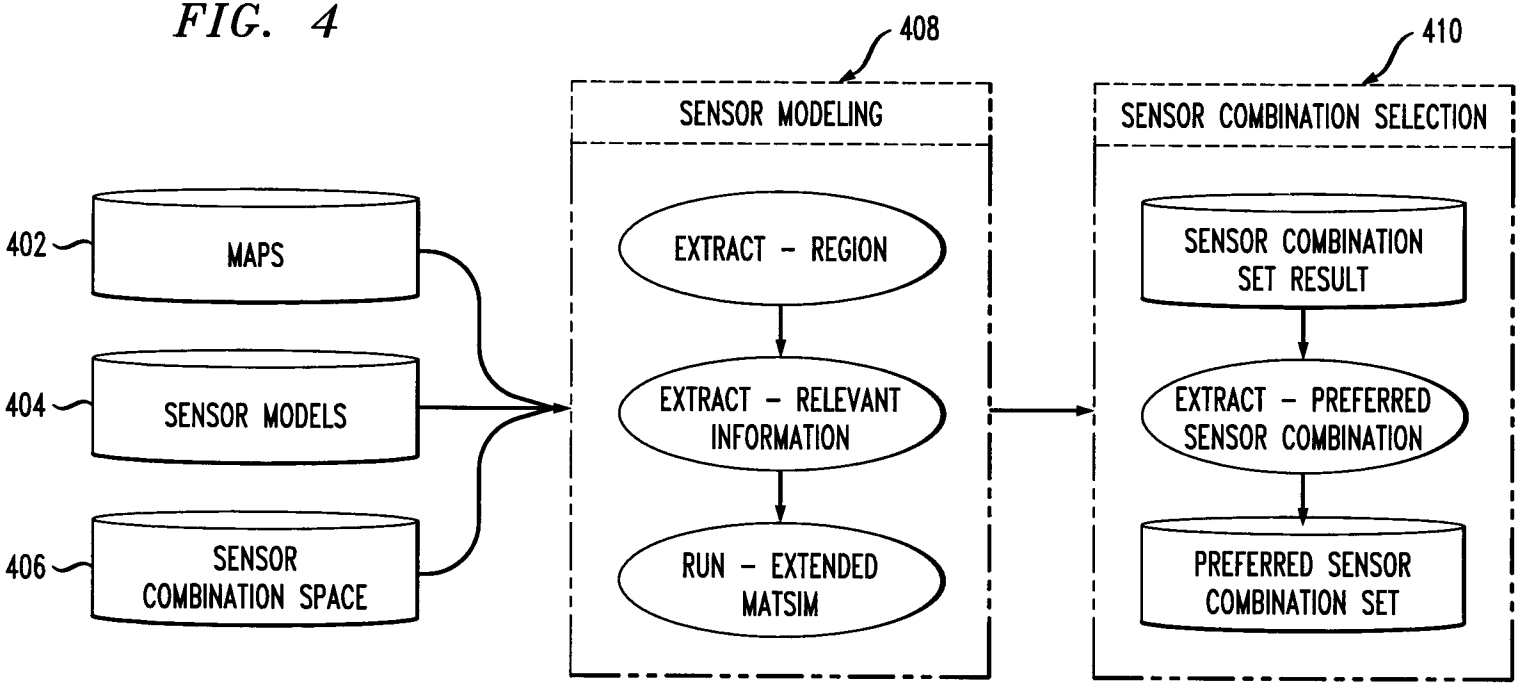
FIG. 4 is a diagram illustrating a framework for determining a preferred sensor combination subset, according to an aspect of the invention.

Accordingly, FIG. 4 is a diagram illustrating a framework for determining a preferred sensor combination subset, according to an aspect of the invention. As depicted in FIG. 4, such a system requires three different category of input information: map information 402, sensor models 404 and sensor combination space 406.

The map input 402 includes a network file which specifies the nodes and links representing the roads of a city region, a plan file representing the vehicles modeled as agents in the region with their source and destinations, and travel requirements, and a network configuration file representing how the vehicles speed may change over time. During execution of a plan, the simulator processes the events, evaluates the path options for agents and ranks them using scoring functions.

With sensor models 404, there are various types of sensors, and each sensor type has a specific set of characteristics. These characteristics define the condition in which the sensors perform the best and present the most promising results. As noted above, traffic sensors can be broadly classified into two categories: stationary and movable. The model of sensors includes characteristics of the sensors.

Sensor combination space 406 includes various sensor combinations that can be created using various sensor types available. The sensor combination is defined as the percentage of sensors available for the given network and vehicles. There are various approaches to define the sensor combination space. By way of example, an embodiment of the invention includes using the approach in which permutations are created by changing the percentage of sensors by a discrete value. Then, a combination space can be created by using all of the permutations possible for all of the sensor types.

As also depicted in FIG. 4, inputs 402, 404 and 406 are provided to a sensor modeling module 408, which ultimately provides input to a sensor combination selection module 410. The sensor modeling module 408 is capable of extracting a region, extracting relevant information and running an extended Matsim. The sensor combination selection module 410 is capable of using a sensor combination set result to extract and store a preferred sensor combination set.

The sensor modeling module 408 checks the integrity of the input map files. Based on the input map files, an aspect of the invention creates the tuple of <sensor, location>. After having the tuple space, SMatsim is run.

In extracting a region, the maps include network, plan and network change information. Network information includes nodes and links. Plan information includes source and destination. Using this information, an aspect of the invention checks that the plan is feasible given the network. If a discrepancy is found, the corresponding plan will be removed from further consideration. A similar process is adapted for the network. If some link or node has been found which is not used by any plan, those links and/or nodes will be removed from further consideration. Given the proper network, its integrity is checked with the network change. If any network change is found not to be used, that information will be removed from further consideration. After doing these integrity checks, the remaining content in the network, plan and network change will be called a region.

In creating a sensor tuple, the input sensor combination from the sensor combination set is mapped with a region. To have integration, an aspect of the invention defines the tuple as <sensor, location>. Location is of two types: vehicle and link due to two types of sensor categories (stationary and movable), as described herein. So the tuple will be <sensor, person> if the sensor is movable and <sensor, link> if the sensor is stationary.

For a particular sensor combination, an aspect of the invention includes creating a tuple space. Tuple space is composed of all of the tuple possible given the percentage of the sensors of each type. The allocation of sensors to a location is chosen randomly. To neutralize the impact of randomness, multiple tuple spaces are created for a particular sensor combination. Statistics of a particular sensor combination can be calculated by averaging the results driven by multiple tuple space.

After getting region and tuple spaces, the SMatsim can be run. After the execution of SMatsim on a configuration, an aspect of the invention outputs statistics. Accuracy (RMSE) and number of times each sensor got triggered can be used as statistics in this system.

Additionally, the results are consolidated, and the preference approaches are run to determine the preferred sensor combination subset. The statistics results can be summarized for a sensor combination from all tuple spaces and the cost of installation and maintenance can be calculated for the sensor using the trigger information from the sensors. The installation cost and maintenance cost is determined by number of trigger occurring on a sensor.

After determining the various parameters for each sensor combination, an aspect of the invention includes applying preference approaches to determine the preferred sensor combination subset (for example, using the algorithm described herein). The utility function is given as input to the ICP approach. A relevance factor can be calculated by determine the range of a sensor combination in ICP where it has the highest value for f function.

Figure 5:
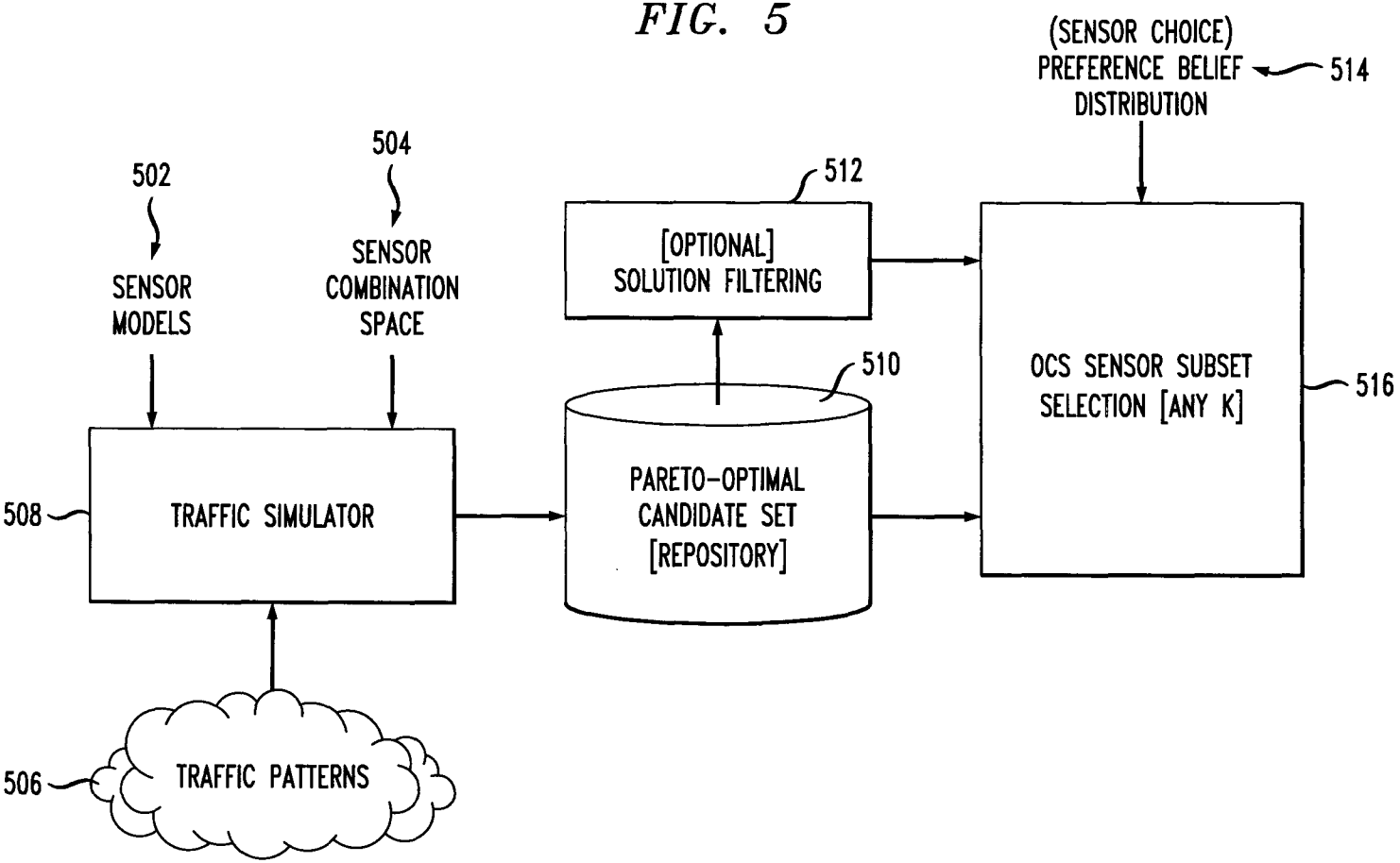
FIG. 5 is a block diagram illustrating an example embodiment, according to an aspect of the invention.

FIG. 5 is a block diagram illustrating an example embodiment, according to an aspect of the invention. By way of illustration, FIG. 5 depicts sensor models 502, sensor combination space 504 and traffic patterns 506, which are provided to the traffic simulator module 508. As detailed herein, decisions that are to be made include, for example, what the structure of the city is, what sensors are under consideration and how the traffic is moving. From these decisions, an embodiment of the invention can include creating other inputs to the system.

By way of example, for a city, a grid is chosen in the illustration. From selection of sensors, a sensor model is created which is a data structure in the simulator corresponding to each sensor type. Its information is the same as what is captured in Table II, for example. The sensor combination space is automatically created based on a scheme of mixing sensor types. First, a number (N) of sensors per sensor type is chosen. Then, each sensor type is varied from 0 to 1 (as a fraction of N) in the increment of 0.1, which can also be expressed as a percentage. The entire set of combinations is referred to herein as the sensor combination choice.

A traffic pattern is the specific way traffic moves in a region. By way of example, consider three traffic patterns on the grid (and this is encoded in the simulator):

Pattern 1: The agents are moving from all of the corners to the center of the network.

Pattern 2: The agents are planning to move from the left bottom-most portion to the right top-most portion of the network.

Pattern 3: The agents are moving from all of the nodes to the center of the network.

The traffic simulator module 508 provides an output to a Pareto-optimal candidate set (OCS) repository 510. The simulator calculates and outputs the sensing error (calculated, for example, by Root Mean Square Error) for a particular combination. The OCS from repository 510 can, in at least one embodiment of the invention, undergo solution filtering at solution filtering module 512 before being sent to OCS sensor subset selection module 516 (the OCS can also be sent without filtering) for selection of any number k. Additionally, a sensor choice or preference belief distribution 514 can also be provided to the OCS sensor subset selection module 516. The preference belief is an input. For example, some cities or entities may prefer lowest cost sensor combination while another may prefer lowest sensing error.

Figure 6:
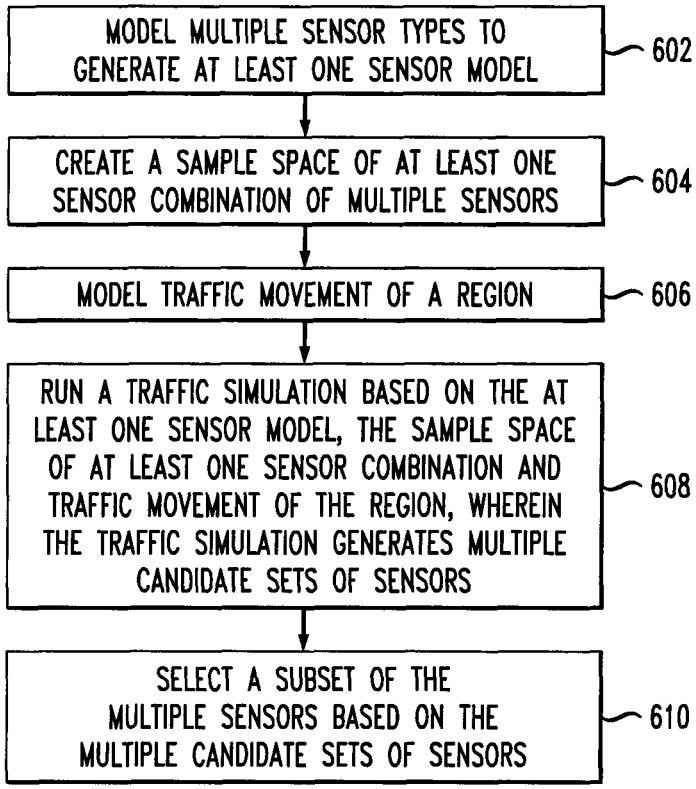
FIG. 6 is a flow diagram illustrating techniques for selecting a subset of at least one traffic sensor, according to an embodiment of the invention.

FIG. 6 is a flow diagram illustrating techniques for selecting a subset of at least one traffic sensor, according to an embodiment of the present invention. Step 602 includes modeling multiple sensor types to generate at least one sensor model. Modeling multiple sensor types includes modeling multiple sensor types based on cost, accuracy and/or coverage. Step 604 includes creating a sample space of at least one sensor combination of multiple sensors. Step 606 includes modeling traffic movement of a region.

Step 608 includes running a traffic simulation based on the at least one sensor model, the sample space of at least one sensor combination and traffic movement of the region, wherein the traffic simulation generates multiple candidate sets of sensors. This step can be carried out, for example, using a traffic simulator module. Running a traffic simulation further includes measuring a sensing error distribution entailed in each sensor combination and ensuring at least one physical characteristic of a relevant location is taken into account.

Step 610 includes selecting a subset of the multiple sensors based on the multiple candidate sets of sensors. This step can be carried out, for example, using a sensor subset selection module. Selecting a subset of the multiple sensors based on the multiple candidate sets of sensors includes selecting a Pareto-optimal combination of sensor choices.

The techniques depicted in FIG. 6 additionally include storing the subset of the multiple sensors in a database and providing the subset of the multiple sensors as an output set to a user. At least one embodiment of the invention also includes filtering the selected subset of the multiple sensors by removing a combination above a give cost threshold, removing a combination above an error threshold, etc. Further, the techniques depicted in FIG. 6 can include providing an approximation of a selected subset of the multiple sensors for a given number, k, of sought choices, which includes selecting a preference function and using ICP approximation.

Additionally, the techniques depicted in FIG. 6 include selecting a given number, k, of subsets of traffic sensors when the selected subset of the multiple sensors and a belief distribution is given. Also, at least one embodiment of the invention includes extending at least one sensor in a region given a current sensor layout via modeling current traffic conditions in a simulator and determining sensor combinations for new cost or error thresholds.

The techniques depicted in FIG. 6 can also, as described herein, include providing a system, wherein the system includes distinct software modules, each of the distinct software modules being embodied on a tangible computer-readable recordable storage medium. All the modules (or any subset thereof) can be on the same medium, or each can be on a different medium, for example. The modules can include any or all of the components shown in the figures. In an aspect of the invention, the modules include a traffic simulator module and a sensor subset selection module that can run, for example on a hardware processor. The method steps can then be carried out using the distinct software modules of the system, as described above, executing on a hardware processor. Further, a computer program product can include a tangible computer-readable recordable storage medium with code adapted to be executed to carry out at least one method step described herein, including the provision of the system with the distinct software modules.

Additionally, the techniques depicted in FIG. 6 can be implemented via a computer program product that can include computer useable program code that is stored in a computer readable storage medium in a data processing system, and wherein the computer useable program code was downloaded over a network from a remote data processing system. Also, in an aspect of the invention, the computer program product can include computer useable program code that is stored in a computer readable storage medium in a server data processing system, and wherein the computer useable program code are downloaded over a network to a remote data processing system for use in a computer readable storage medium with the remote system.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in a computer readable medium having computer readable program code embodied thereon.

An aspect of the invention or elements thereof can be implemented in the form of an apparatus including a memory and at least one processor that is coupled to the memory and operative to perform exemplary method steps.

Figure 7:
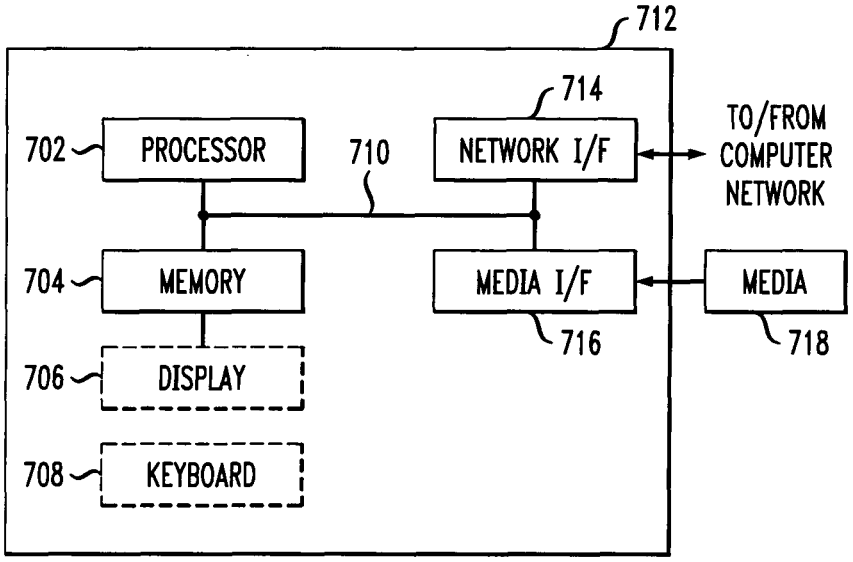
FIG. 7 is a system diagram of an exemplary computer system on which at least one embodiment of the invention can be implemented.

Additionally, an aspect of the present invention can make use of software running on a general purpose computer or workstation. With reference to FIG. 7, such an implementation might employ, for example, a processor 702, a memory 704, and an input/output interface formed, for example, by a display 706 and a keyboard 708. The term "processor" as used herein is intended to include any processing device, such as, for example, one that includes a CPU (central processing unit) and/or other forms of processing circuitry. Further, the term "processor" may refer to more than one individual processor. The term "memory" is intended to include memory associated with a processor or CPU, such as, for example, RAM (random access memory), ROM (read only memory), a fixed memory device (for example, hard drive), a removable memory device (for example, diskette), a flash memory and the like. In addition, the phrase "input/output interface" as used herein, is intended to include, for example, a mechanism for inputting data to the processing unit (for example, mouse), and a mechanism for providing results associated with the processing unit (for example, printer). The processor 702, memory 704, and input/output interface such as display 706 and keyboard 708 can be interconnected, for example, via bus 710 as part of a data processing unit 712. Suitable interconnections, for example via bus 710, can also be provided to a network interface 714, such as a network card, which can be provided to interface with a computer network, and to a media interface 716, such as a diskette or CD-ROM drive, which can be provided to interface with media 718.

Accordingly, computer software including instructions or code for performing the methodologies of the invention, as described herein, may be stored in an associated memory devices (for example, ROM, fixed or removable memory) and, when ready to be utilized, loaded in part or in whole (for example, into RAM) and implemented by a CPU. Such software could include, but is not limited to, firmware, resident software, microcode, and the like.

A data processing system suitable for storing and/or executing program code will include at least one processor 702 coupled directly or indirectly to memory elements 704 through a system bus 710. The memory elements can include local memory employed during actual implementation of the program code, bulk storage, and cache memories which provide temporary storage of at least some program code in order to reduce the number of times code must be retrieved from bulk storage during implementation.

Input/output or I/O devices (including but not limited to keyboards 708, displays 706, pointing devices, and the like) can be coupled to the system either directly (such as via bus 710) or through intervening I/O controllers (omitted for clarity).

Network adapters such as network interface 714 may also be coupled to the system to enable the data processing system to become coupled to other data processing systems or remote printers or storage devices through intervening private or public networks. Modems, cable modem and Ethernet cards are just a few of the currently available types of network adapters.

As used herein, including the claims, a "server" includes a physical data processing system (for example, system 712 as shown in FIG. 7) running a server program. It will be understood that such a physical server may or may not include a display and keyboard.

As noted, aspects of the present invention may take the form of a computer program product embodied in a computer readable medium having computer readable program code embodied thereon. Also, any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using an appropriate medium, including but not limited to wireless, wireline, optical fiber cable, RF, etc., or any suitable combination of the foregoing. Computer program code for carrying out operations for aspects of the present invention may be written in any combination of at least one programming language, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described herein with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks. Accordingly, an aspect of the invention includes an article of manufacture tangibly embodying computer readable instructions which, when implemented, cause a computer to carry out a plurality of method steps as described herein.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods and computer program products according to various embodiments of the present invention. In this regard, each block in the flowchart or block diagrams may represent a module, component, segment, or portion of code, which comprises at least one executable instruction for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It should be noted that any of the methods described herein can include an additional step of providing a system comprising distinct software modules embodied on a computer readable storage medium; the modules can include, for example, any or all of the components detailed herein. The method steps can then be carried out using the distinct software modules and/or sub-modules of the system, as described above, executing on a hardware processor 702. Further, a computer program product can include a computer-readable storage medium with code adapted to be implemented to carry out at least one method step described herein, including the provision of the system with the distinct software modules.

In any case, it should be understood that the components illustrated herein may be implemented in various forms of hardware, software, or combinations thereof; for example, application specific integrated circuit(s) (ASICS), functional circuitry, an appropriately programmed general purpose digital computer with associated memory, and the like. Given the teachings of the invention provided herein, one of ordinary skill in the related art will be able to contemplate other implementations of the components of the invention.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of another feature, integer, step, operation, element, component, and/or group thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

At least one aspect of the present invention may provide a beneficial effect such as, for example, determining a subset of sensors from available types that provide a suitable cost-benefit outcome for a given traffic pattern.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method for selecting a subset of traffic sensors, wherein the method comprises:

modeling multiple sensor types to generate at least one sensor model;

creating a sample space of at least one sensor combination of multiple sensors;

modeling traffic movement of a region;

running a traffic simulation based on the at least one sensor model, the sample space of at least one sensor combination and traffic movement of the region, wherein the traffic simulation generates multiple candidate sets of sensors and measures a sensing error distribution entailed in each of the multiple candidate sets of sensors;

selecting a subset of the multiple sensors from the multiple candidate sets of sensors based on the sensing error distribution entailed in each of the multiple candidate sets of sensors and at least one additional criterion; and filtering the selected subset of the multiple sensors, wherein said filtering comprises removing a sensor combination from the sample space above an error threshold;

wherein at least one of the steps is carried out by a computer device.

2. The method of claim 1, further comprising storing the subset of the multiple sensors in a database.

3. The method of claim 1, further comprising providing the subset of the multiple sensors as an output set to a user.

4. The method of claim 1, wherein modeling multiple sensor types comprises modeling the multiple sensor types based on cost.

5. The method of claim 1, wherein modeling multiple sensor types comprises modeling the multiple sensor types based on accuracy.

6. The method of claim 1, wherein modeling multiple sensor types comprises modeling the multiple sensor types based on coverage.

7. The method of claim 1, wherein running a traffic simulation based on the at least one sensor model and the sample space of at least one sensor combination further comprises ensuring at least one physical characteristic of at least one additional location is taken into account.

8. The method of claim 1, wherein selecting a subset of the multiple sensors from the multiple candidate sets of sensors comprises selecting a Pareto-optimal combination of sensor choices.

9. The method of claim 1, wherein filtering the selected subset of the multiple sensors comprises removing a sensor combination from the sample space above a given cost threshold.

10. The method of claim 1, further comprising providing an approximation of a selected subset of the multiple sensors for a given number, k, of sought choices.

11. The method of claim 10, further comprising selecting a preference function.

12. The method of claim 10, further comprising using Integrated Convex Preference approximation.

13. The method of claim 1, further comprising selecting a given number, k, of subsets of traffic sensors when the selected subset of the multiple sensors and a belief distribution is given.

14. The method of claim 1, further comprising extending at least one sensor in a region given a current sensor layout.

15. The method of claim 14, wherein extending at least one sensor in a region comprises:

modeling current traffic conditions in a simulator; and determining sensor combinations for new cost or error thresholds.

16. The method of claim 1, further comprising:

providing a system, wherein the system comprises at least one distinct software module, each distinct software module being embodied on a tangible computer-readable recordable storage medium, and wherein the at least one distinct software module comprises a traffic simulator module and a sensor subset selection module executing on a hardware processor.

* * * * *